US006474473B2

(12) United States Patent
Wong

(10) Patent No.: US 6,474,473 B2
(45) Date of Patent: Nov. 5, 2002

(54) SHIPPING AND DISPLAY CONTAINER FOR BOTTLES

(75) Inventor: Wilbur Wong, Richmond, CA (US)

(73) Assignee: International Paper Company, NY (US)

( * ) Notice: Subject to any disclaimer, the term of this patent is extended or adjusted under 35 U.S.C. 154(b) by 0 days.

(21) Appl. No.: 09/737,367

(22) Filed: Dec. 15, 2000

(65) Prior Publication Data

US 2001/0040113 A1 Nov. 15, 2001

Related U.S. Application Data

(60) Provisional application No. 60/172,689, filed on Dec. 20, 1999.

(51) Int. Cl.[7] ..... B65D 81/05; B65D 75/00; B65D 85/20

(52) U.S. Cl. ..... 206/590; 206/427; 206/443; 206/446; 206/485

(58) Field of Search ..... 206/443, 446, 206/485, 571, 590, 427

(56) References Cited

U.S. PATENT DOCUMENTS 1,217,283 A * 2/1917 Daniel et al. ..... 206/443
1,470,150 A * 10/1923 Davis ..... 206/443
1,585,498 A * 5/1926 Kenyon ..... 206/485
1,803,028 A * 4/1931 Menten ..... 206/443
3,416,648 A * 12/1968 Levi ..... 206/446
3,741,382 A * 6/1973 Larimer, Sr. ..... 206/446
4,341,308 A * 7/1982 Pasquini ..... 206/427
4,450,965 A * 5/1984 Paillet ..... 206/485

* cited by examiner

*Primary Examiner*—Bryon P. Gehman
(74) *Attorney, Agent, or Firm*—Dennis H. Lambert

(57) ABSTRACT

A shipping and display container for bottles or other frangible articles, in which mating insert half sections of cardboard or other material have recessed portions defining supports for nesting and supporting the articles along three spatial axes. An insert section may be used as a display container for the article or articles, and two insert sections placed together in mirror image relationship from opposite sides of the articles and placed in a box form a container for shipment. The insert sections are each formed from a single blank, and may be shipped flat or in an erected or partially erected condition. Panels of the insert sections interlock when erected to hold the insert section in erected condition, and adhesive may be used between some panels to assist in holding the insert section erected and to enhance the strength and rigidity of the insert section.

23 Claims, 8 Drawing Sheets

10
11
12
13
14

SHIPPING AND DISPLAY CONTAINER FOR BOTTLES

This application claims the benefit of U.S. provisional patent application serial No. 60/172,689, filed Dec. 20, 1999, entitled "Shipping Container For Bottles".

BACKGROUND OF THE INVENTION

1. Field of the Invention

This invention relates generally to containers. More specifically, the invention relates to a shipping and display container for bottles and other fragile articles.

2. Prior Art

There are a variety of packaging containers currently in use for shipping bottles, ampoules, computer chips and other articles of a fragile nature. These containers must be capable of protecting the articles during shipping and handling, and should also be simple and economical in construction and use.

For economy of packaging, the containers are often constructed to hold a plurality of the articles, and for protection, the articles are preferably individually held in spaced apart relationship to one another in the package. U.S. Pat. Nos. 5,752,605, 5,494,166, 5,361,907, 4,450,965, 4,341,308 and 4,173,286, and U.K. Patents 393,630 and 701,212, published Jul. 6, 1933, and Dec. 23, 1953, respectively, are exemplary of prior art containers of this type. Many of these prior art containers are made of cardboard or similar material, and some are formed from a single blank of material. See, e.g., U.K. Patent 701,212. Other containers comprise a folded insert received in an outer housing or box. See, e.g., U.S. Pat. No. 4,341,308 and U.K. Patent 393,630.

U.S. Pat. No. 4,173,286 discloses a packaging container for shipping cans, and includes mating half sections each formed with recessed areas for receiving respective half-sections of the cans. The container in this patent is made of a cellular resin such as styrofoam or polyurethane, and the two half sections are secured together by pressure sensitive tape.

In spite of the existence of a large variety of prior art shipping containers, only boxes and inserts using full shell molded EPS have been certified for use by United Parcel Service (UPS) and other shipping carriers. Applicant is not aware of any prior art corrugated boxes and inserts and/or dividers, or molded pulp containers, that have been successful in obtaining certification.

Accordingly, there is need for a box and insert packaging container that is capable of withstanding the shipping hazards encountered when articles are shipped via UPS and other shipping carriers.

SUMMARY OF THE INVENTION

The present invention is a shipping and display container for bottles or other frangible articles, in which mating half sections of cardboard or other material have recessed portions defining supports for nesting and supporting the articles along three spatial axes when two half sections are placed together from opposite sides of the articles to enclose them. In a preferred embodiment, the assembled half sections are placed in a box for shipment. The resulting container is capable of withstanding the shipping hazards encountered when articles are shipped via UPS and other shipping carriers.

Each insert half section forming a part of the container of the invention is also capable of functioning independently as a display container for the articles.

Each half section is formed from a single blank of material, such as corrugated cardboard, folded to form support structures that suspend and support the article along three axes, and can be constructed so that it is self-locking when it is folded into an erected condition, or certain panels can be glued to retain the half section in an erected condition. Strength and torsional rigidity of the half section are improved by gluing certain panels together. Gluing can be accomplished by the package manufacturer to insure that improved strength and torsional rigidity are obtained and to facilitate and reduce the labor of packing.

The container of the invention may be shipped in either flat or partially erected condition, even with some panels glued to other panels, and is suitable for use with bottles or other articles. For instance, in some cases dissimilar articles may be shipped and displayed in the container, in which case, the half sections may also be dissimilar. The pre-glued or flat form can be adapted for full automatic machine erection into a condition ready to accept the articles.

Multiple sets of half section pairs may be assembled, with each set or pair of half sections maintained assembled by a sleeve, if desired, and the multiple sets then placed in a larger box for shipment of larger quantities of articles.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figures 1, 2:
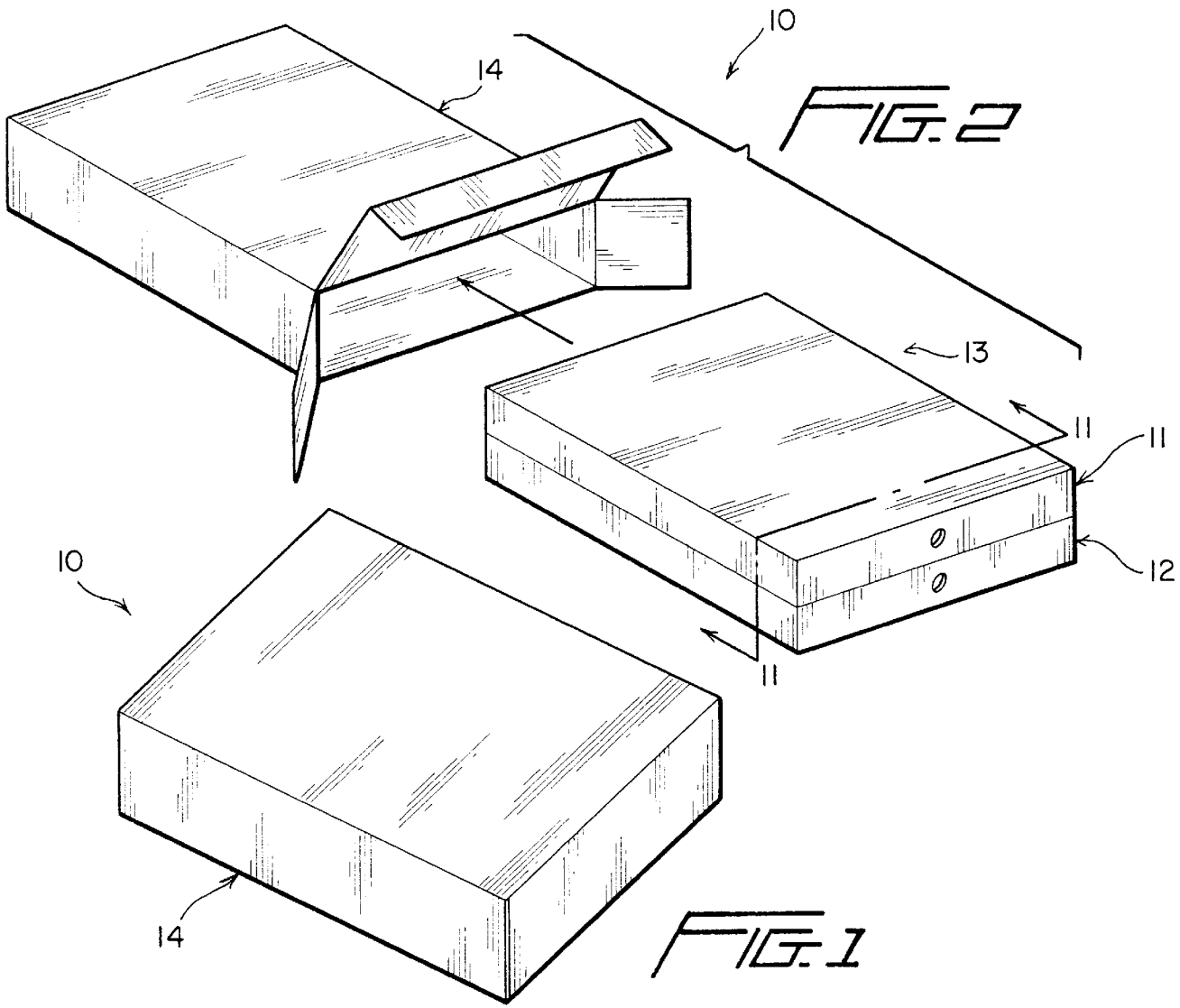
FIG. 1 is a top perspective view of a shipping container according to the invention.
FIG. 2 is an exploded top perspective view of the insert and box forming the container of the invention.

Referring more particularly to the drawings, a shipping and display container according to the invention is indicated generally at 10 in FIGS. 1 and 2. The container comprises two half sections 11 and 12 which together form an insert 13 that is placed in a box 14. The insert 13 and box 14 are preferably made of corrugated cardboard or similar material, whereby they are lightweight, inexpensive and recyclable.

Figure 3:
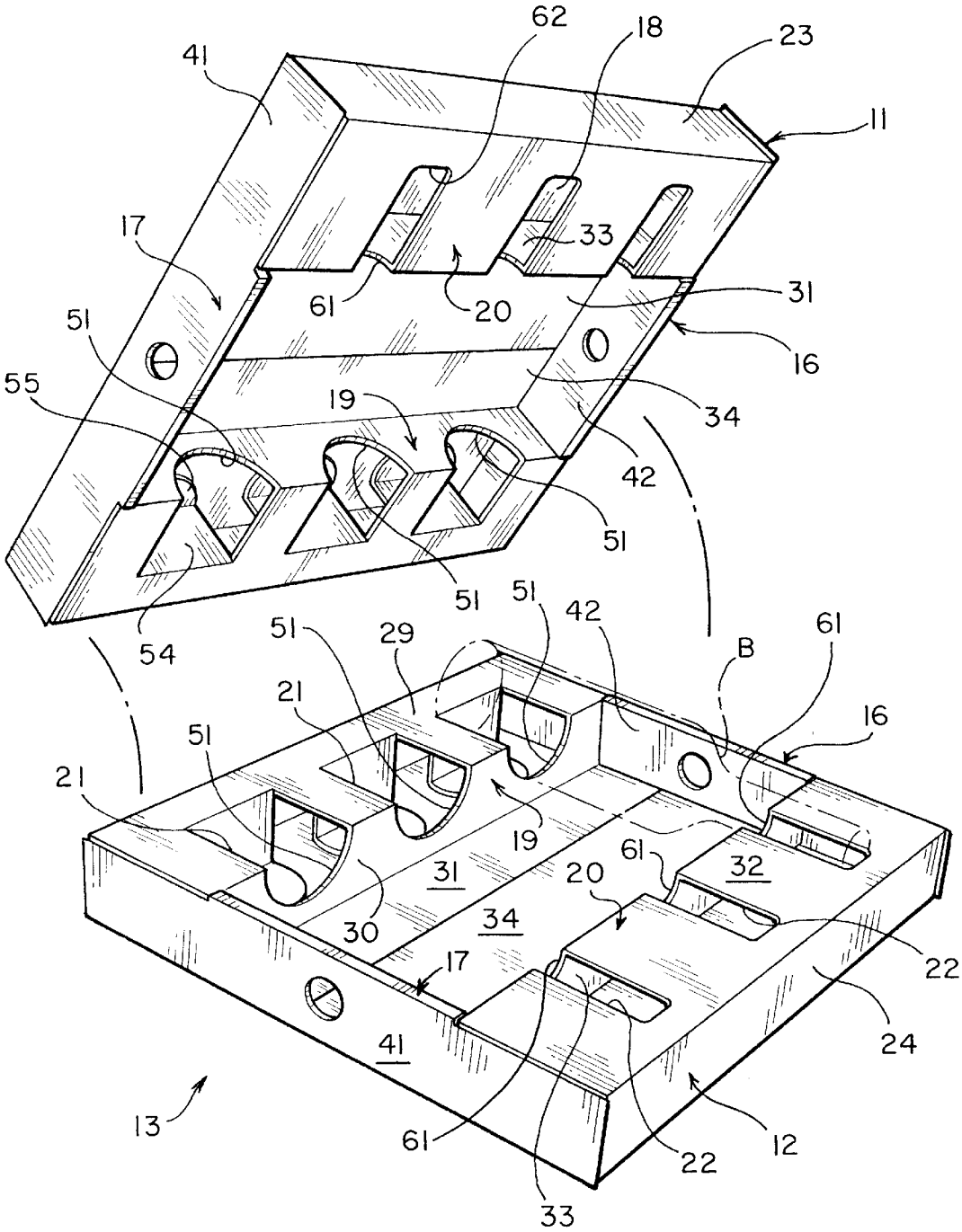
FIG. 3 is an exploded top perspective view of the two half sections forming the insert of the container of the invention.
Figure 10:
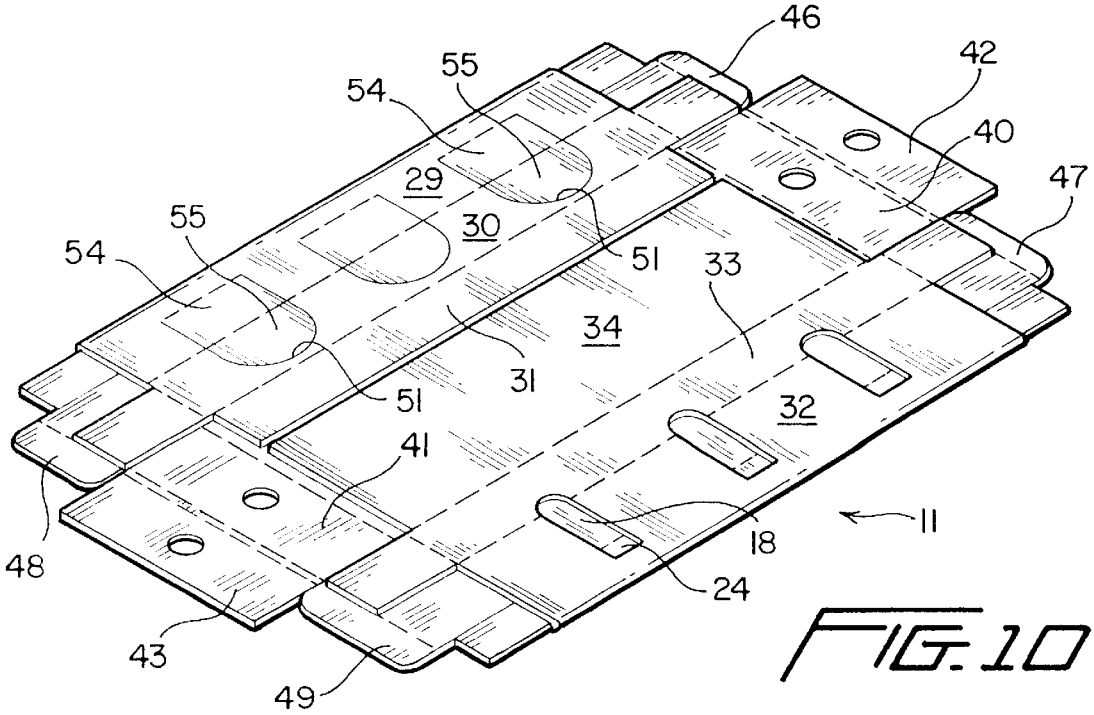
FIG. 10 is a top perspective view of an insert half section according to the invention, shown in flattened condition for compact storage and/or shipment.
Figure 9:
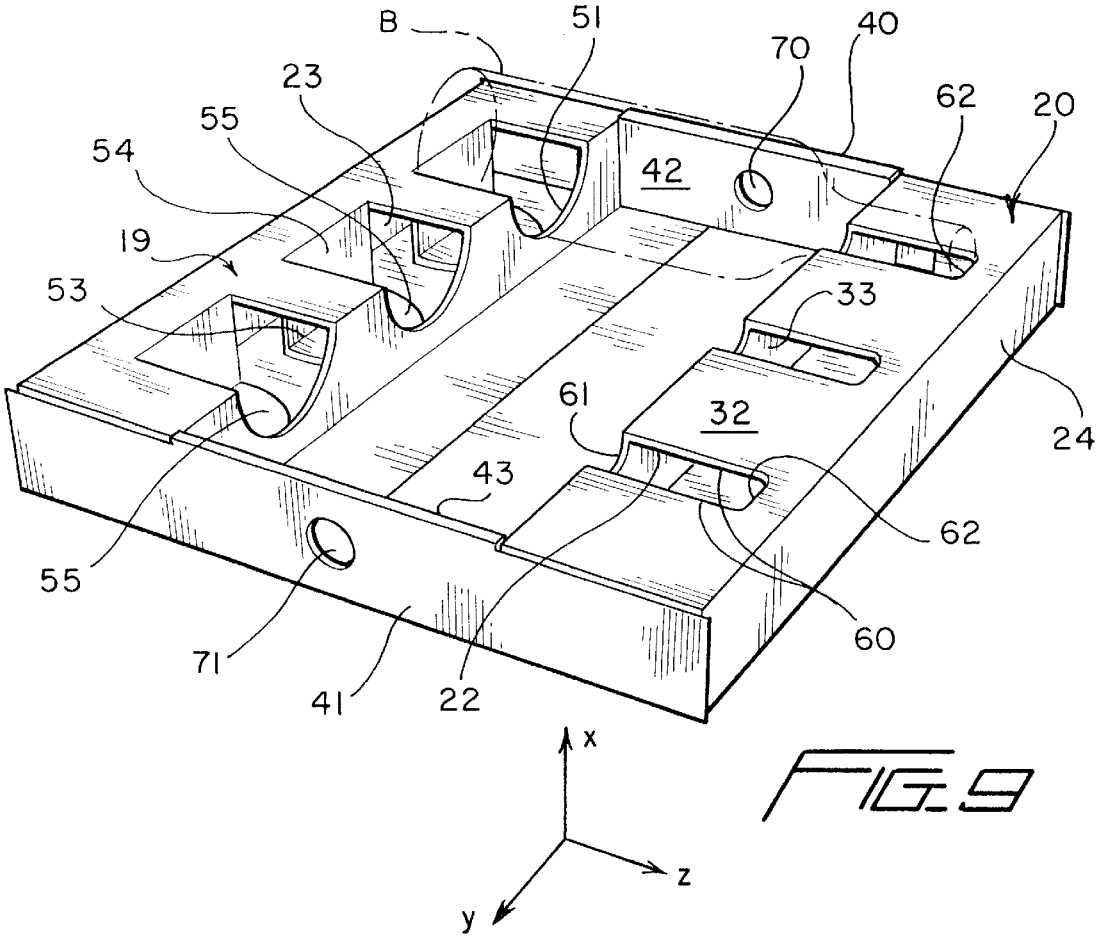
FIG. 9 is a top perspective view of the insert half section in fully erected condition, ready to receive a bottle.

As seen best in FIGS. 3, 9 and 10, the container 10 illustrated and described herein is especially adapted to hold a plurality of bottles B, although by appropriate modification (not shown) the container could be adapted to hold other types of articles, such as ampoules or the like. Moreover, the container could be adapted to hold only a single bottle or other article, rather than a plurality as shown.

In one embodiment, the half sections 11 and 12 forming the insert 13 are substantially identical tray-like constructions, adapted to be arranged in mirror image relationship to one another about an article or articles, and each is formed from a single flat blank 15 (FIG. 4) suitably die-cut (solid lines) and creased (dashed lines) so that when folded into its erected condition certain panels interlock to hold the section erected. The insert sections 11 and 12 each have opposite end wall structures 16 and 17, a back wall 18, and quadrilateral box-like support structures 19 and 20 along opposite sides. The box-like support structures have shaped cut-outs or recesses 21 and 22 formed therein, respectively, adapted to receive and hold half sections of the opposite ends of an article, such as bottle B, whereby when an article is nested in the recesses of one insert section, and another insert section is then placed in mating registry over the top of the article and first insert section, as shown in FIGS. 2, 3 and 10, the article is securely supported and held along all three spatial axes.

One of the insert sections 11 will be described in detail hereinafter, it being understood that description of insert section 11 also suffices for insert section 12, which will not be separately described.

Figure 4:
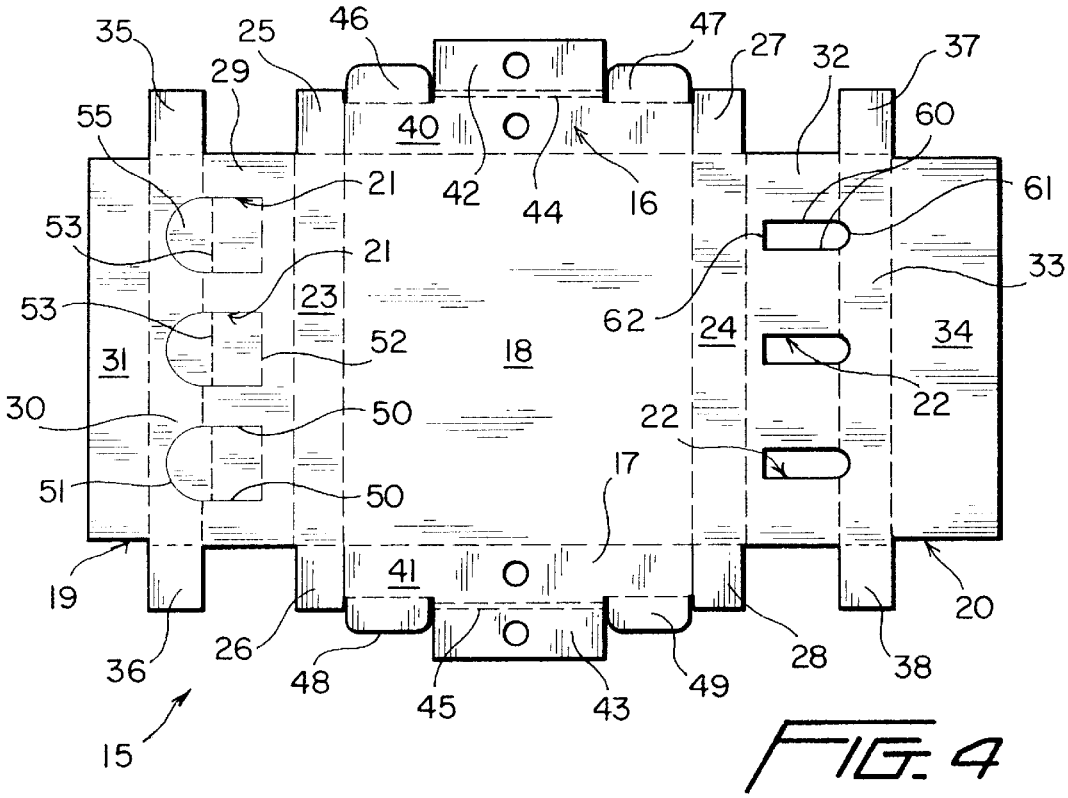
FIG. 4 is a top plan view of the blank used to make one of the insert half sections.

As seen in FIG. 4, the back wall 18 of the insert section comprises a large rectangular center panel of the blank 15. A first pair of relatively narrow rectangular panels 23 and 24 of predetermined width foldably joined to opposite sides of the center panel 18 form outer side walls of the quadrilateral structures 19 and 20 at opposite sides of the half section. Side wall flaps 25, 26 and 27, 28 are foldably joined to opposite ends of the panels 23 and 24, respectively, for a purpose to be described later.

The quadrilateral structure 19 further includes a top wall panel 29 foldably joined to a top edge of the outer side wall panel 23 and extending laterally inwardly therefrom over the back wall panel 18 in parallel, spaced relationship thereto. An inner wall panel 30 is foldably joined to an inner edge of the top wall 29 and extends downwardly in parallel, spaced relationship to the outer wall 23, terminating at its lower edge in a lower panel 31 that lies flat against the back wall 18. Panel 30 is of the same width as the panels 23 and 24.

The quadrilateral box-like support structure 20 similarly includes a top wall panel 32 foldably joined to a top edge of the outer side wall panel 24 and extending laterally inwardly therefrom over the back wall panel 18 in parallel, spaced relationship thereto. An inner wall panel 33 is foldably joined to an inner edge of the top wall 32 and extends downwardly in parallel, spaced relationship to the outer wall 24, terminating at its lower edge in a lower panel 34 that lies flat against the back wall 18. The inner wall panel 33 is of the same width as the panels 23, 24 and 30.

The innermost edges of panels 31 and 34 are contiguous to one another, as shown in FIGS. 6–9.

Inner wall panel flaps 35, 36 and 37, 38, respectively, are foldably joined to opposite ends of the inner walls or panels 30 and 33, for a purpose to be described hereinafter.

The end wall structures 16 and 17 at opposite ends of the insert section comprise a second pair of relatively narrow rectangular panels 40 and 41 foldably joined along respective opposite ends of the panel 18, forming outer panels of the opposite end walls in the erected section. The panels 40 and 41 are the same width as the panels 23, 24, 30 and 33. A third pair of relatively narrow rectangular panels 42 and 43 are joined to the second pair of panels 40 and 41 along double fold lines 44 and 45, respectively, and form inner panels of the opposite end wall structures. The panels 42 and 43 are substantially the same width as the panels 40 and 41, but are shorter in length than the panels 40 and 41 and are located at midportions of the panels 40 and 41. As seen best in FIGS. 6–9, the length of the panels 42 and 43 is approximately the same as, or just slightly less than, the distance between the inner walls or panels 30 and 33 of the box-like support structures at opposite sides of the insert section.

The length of the panels 40 and 41 is approximately the same as the width of the insert section, and pairs of flaps 46, 47 and 48, 49 are foldably joined to upper, outer edge portions of the panels 40 and 41, respectively, in alignment with the ends of the box-like support structures at opposite sides of the insert section.

The cut-outs or recesses 21 in box-like support structure 19 are formed by making one or more pairs of spaced parallel cuts 50 in panel 29, extending from near an outer edge of the panel (in the erected insert section as shown in FIGS. 6–9) through the inner edge thereof, and joining the inner ends of the cuts 50 of each pair with a U-shaped cut 51 in panel 30, with the bottom end of the U-shaped cut 51 spaced upwardly from the lower edge of inner panel 30. The material within the cuts 50 and 51 is not removed, but is joined to panel 29 along a fold line 52. A fold line 53 is also formed in the material bounded by the cuts, in the area between the folds delimiting the panel 29 and at a location spaced slightly outwardly from the fold line delimiting the inner edge of panel 29 (seen best in FIG. 4).

In the erected insert section, the portion of the material between the fold lines 52 and 53 extends perpendicularly between the panels 18 and 29, defining an abutment 54, and the portion of the material within the arcuate cut 51 defines a pad or foot 55 that lies flat against the panel 18.

The cut-outs or recesses 22 in box-like support structure 20 are defined by one or more pairs of spaced parallel cuts 60 formed in the panel 32, joined at their inner ends (as viewed in the erected insert section, FIGS. 6–9) by a U-shaped cut 61 in the panel 33, and at their other or outer ends by a straight cut 62 in the panel 32. The material bounded by these cuts is removed.

Figure 5:
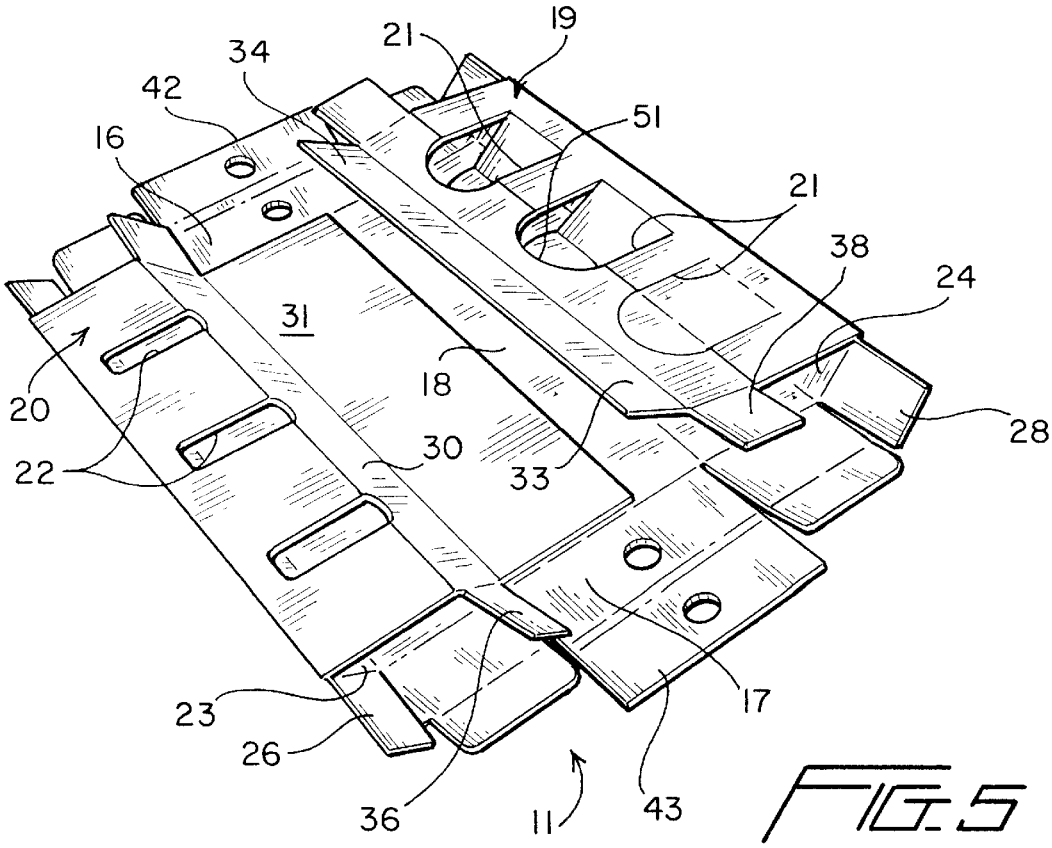
FIGS. 5–8 are top perspective views of one of the insert half sections, shown in progressively erected conditions.

To erect the insert section, the opposite sides of the blank are folded inwardly over the panel 18, bringing the inner edges of panels 31 and 34 into abutting relationship with one another as depicted in FIG. 5. If desired, adhesive can be applied in the area between the panel 18 and the panels 31 and 34, and between the pads 55 and the panel 18. Although the insert section is self-locking and will remain in an erected condition without the use of adhesive, the use of adhesive improves the strength and rigidity of the insert section and simplifies packaging by the end user.

Figure 6:
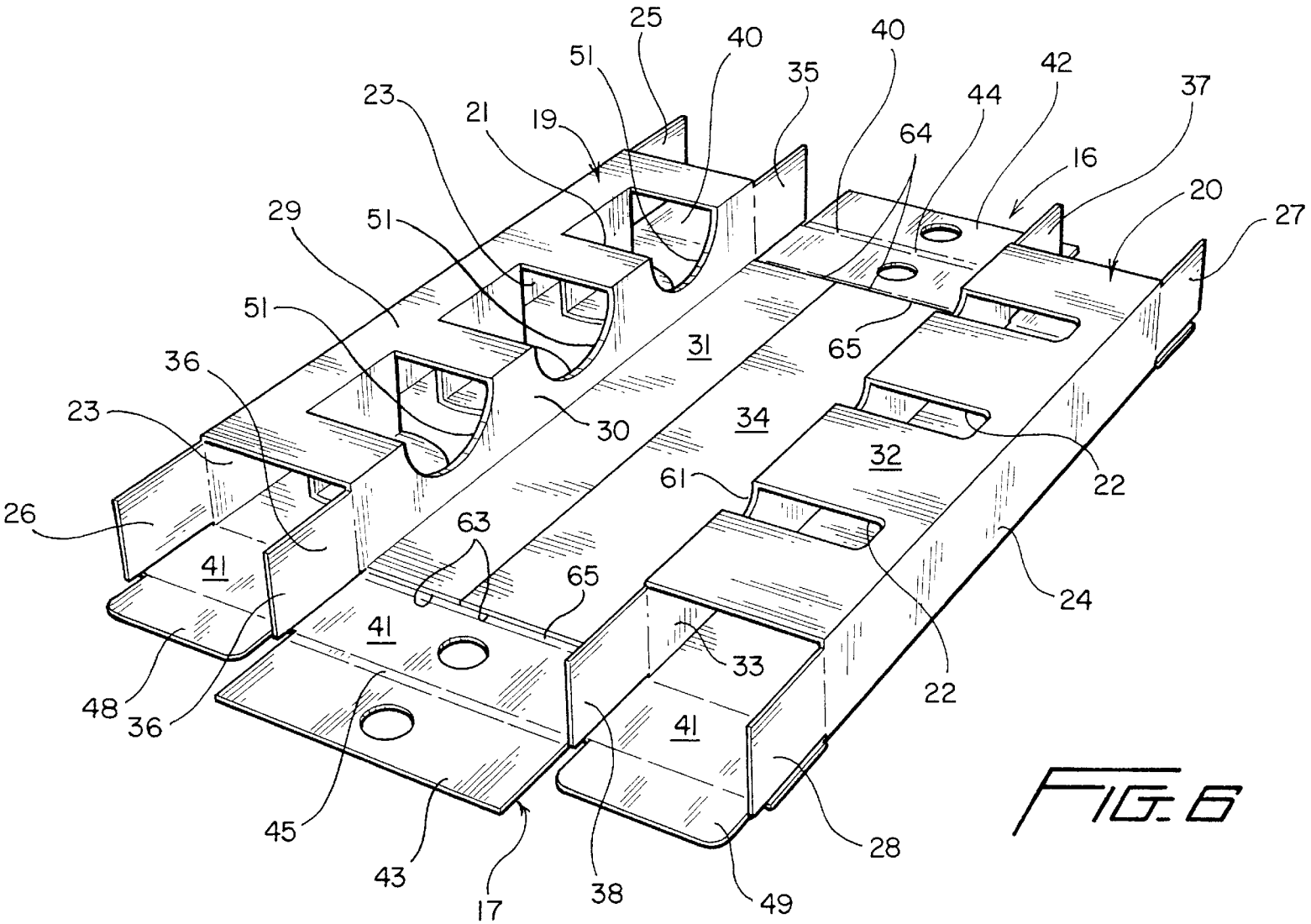
Figure 7:
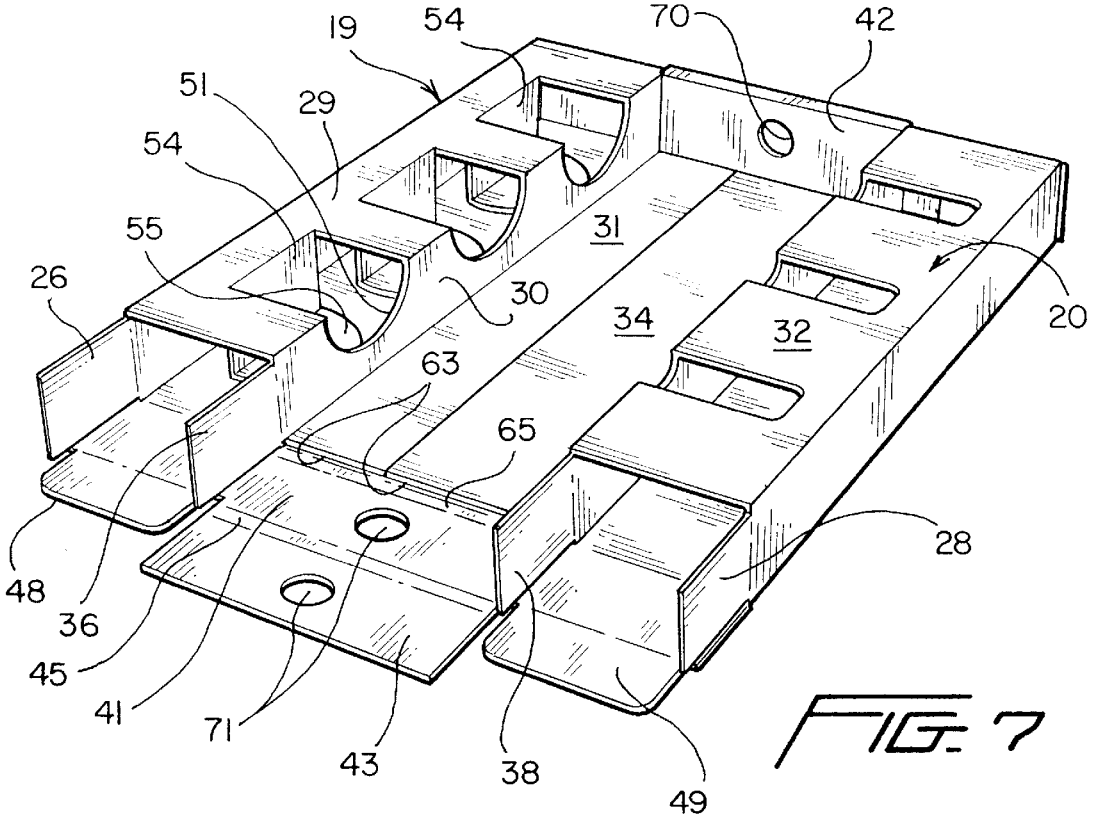

The panels forming the box-like support structures 19 and 20 are then pivoted upwardly and inwardly to the positions shown in FIG. 6. It will be noted that the opposite end edges 63 and 64, respectively, of panels 31 and 34 terminate short of the opposite ends of the panel 18, whereby a narrow space 65 is formed adjacent the opposite end walls. This space forms part of the interlocking structure to hold the insert section erected, as described below.

Figure 8:
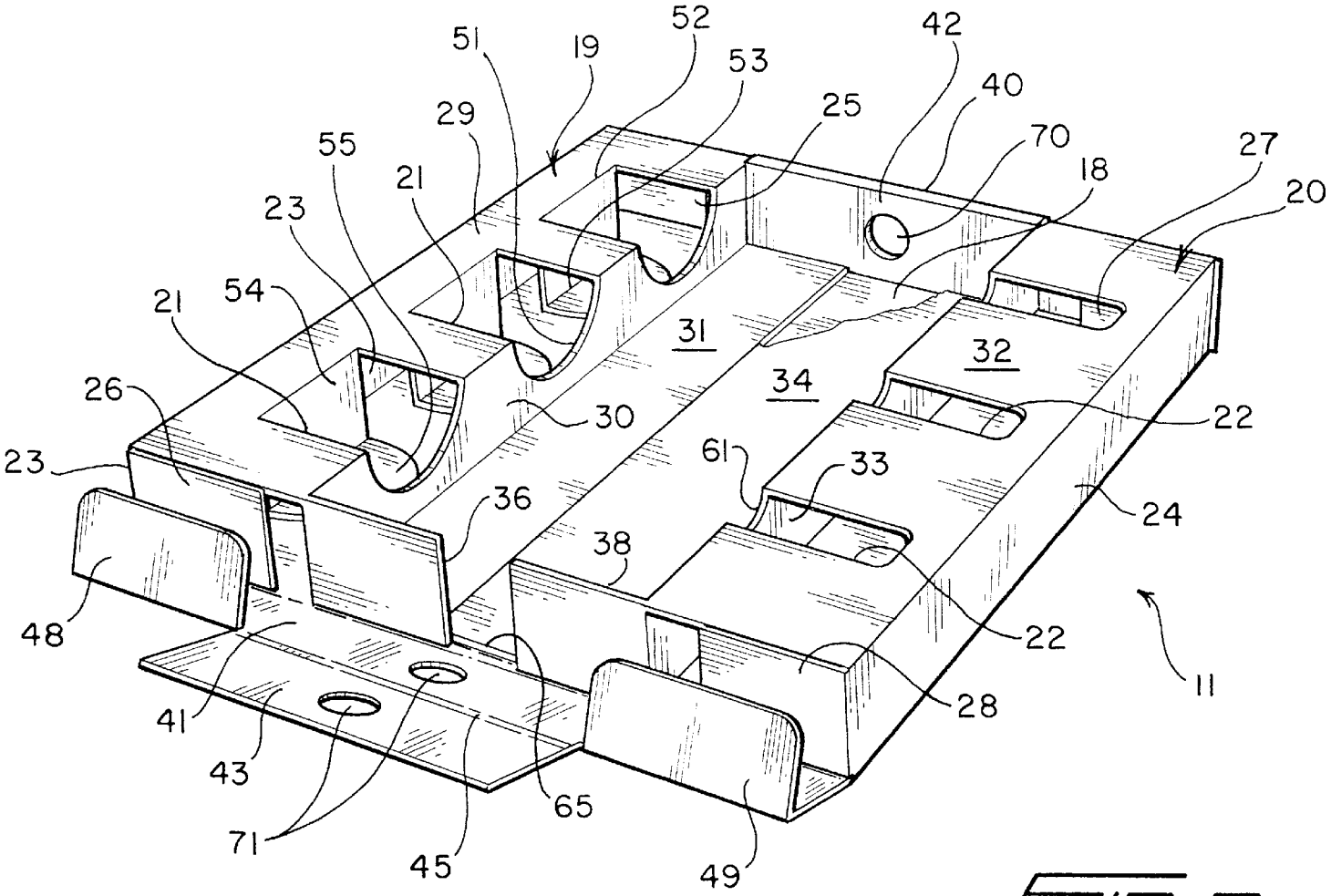

With the box-like support structures 19 and 20 erected into their tubular configuration shown in FIGS. 6–9, the flaps 25, 26, 27, 28, 35, 36, and 37, 38 are folded inwardly toward the longitudinal centerline of the insert section, as depicted in FIG. 8. The panels 40 and 41 are then folded upwardly against the opposite ends of the insert section, and against the outer surfaces of the flaps 25–28 and 35–38, with the flaps 46, 48 and 47, 49 being inserted into the ends of the structures 19 and 20. Panels 42 and 43 are then folded downwardly over the flaps 35, 37 and 36, 38 so that the lower edges of the panels 42 and 43 are received in the spaces 65, whereby the lower edges of the panels 42 and 43 are trapped behind the edges 63 and 64 of the panels 31 and 34. With this arrangement, all of the panels are locked in their erected conditions.

Openings 70 and 71 are formed through the panels 40, 42 and 41, 43 to serve as finger access openings to facilitate handling of the insert 13, and especially to facilitate withdrawing the insert from the box 14.

It should be noted that in addition to serving as a shipping container for bottles or other articles, the insert sections of the invention can be used to display one or more bottles by removing one of the sections and placing the other containing the articles on a surface.

The cuts 51 and 61 in the walls 30 and 33, respectively, of the support structures 19 and 20, define cradles which support the bottles against movement in the X and Y directions, while the abutments 54 and end 62 support the bottles against movement in the Z direction. See FIG. 9. Moreover, the spacing of the cradles from the back walls 18 and ends 16, 17 of the insert sections, and the spacing of the abutments from the sides of the insert sections, protects the bottles from impacts against the outside of the insert sections and/or the box holding them.

The container of the invention, including the box 14 and the insert sections 11 and 12, may be shipped flat or erected. An insert half section 11 is shown in FIG. 10 in a flattened condition. To erect the insert half section, the opposite sides are pivoted inwardly and upwardly so that the walls 24, 33 and 23, 30 are upright and perpendicular to the back wall panel 18. See FIG. 6. The end flaps are then folded into interlocking relationship as described previously. See FIGS. 7–9.

Figure 11:
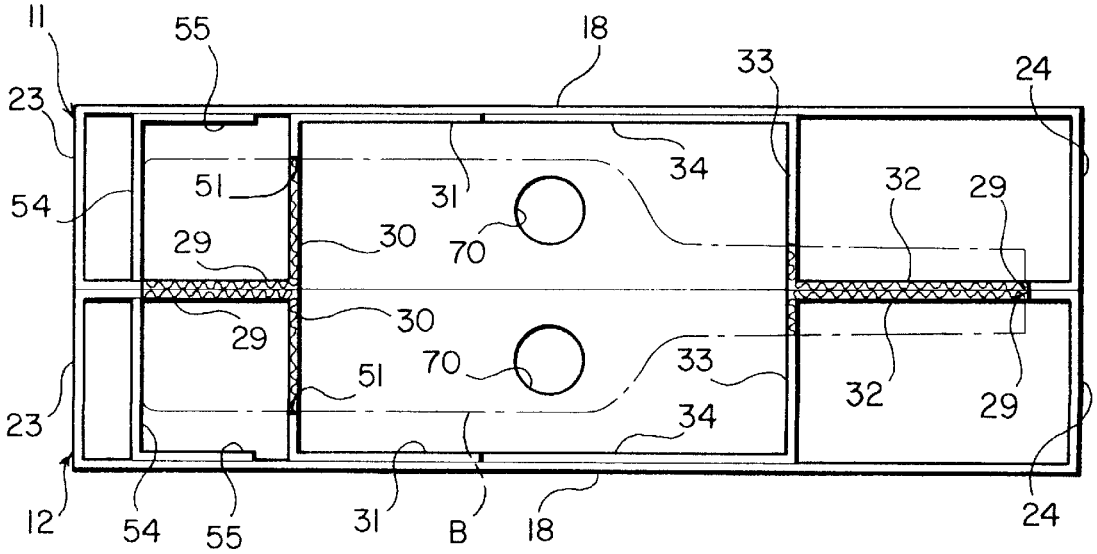
FIG. 11 is a transverse sectional view taken along line 11—11 in FIG. 2.

FIG. 11 shows a pair of insert half sections 11 and 12 assembled together with one or more bottles B held therebetween.

Figures 12, 13:
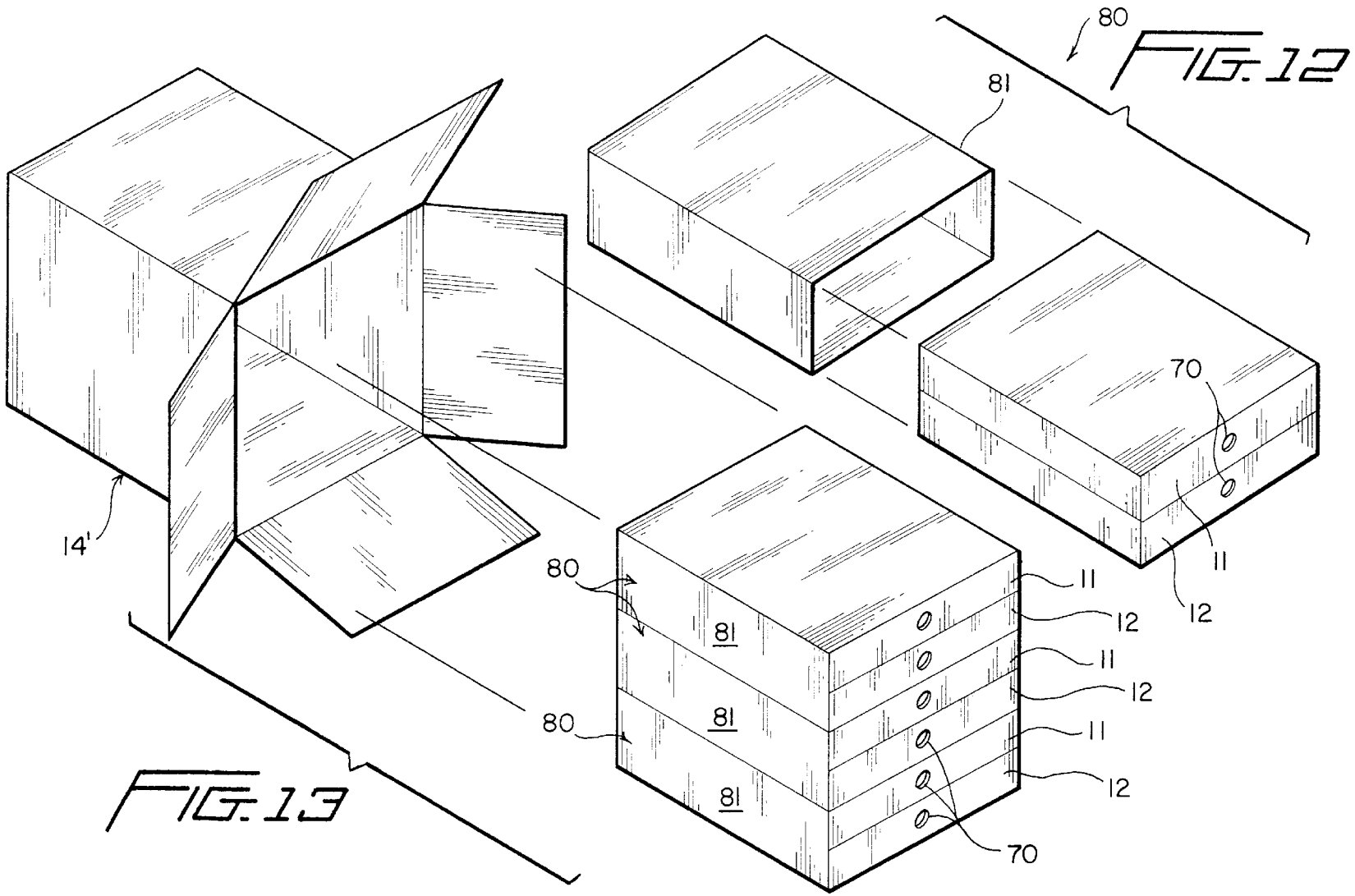
FIG. 12 is an exploded top perspective view of one set or pair of assembled insert half sections and the sleeve used to hold them assembled.
FIG. 13 is an exploded top perspective view of multiple sets or pairs of sleeved insert half sections and a larger box in which they may be placed.

FIGS. 12 and 13 depict another way in which the container of the invention may be utilized. In this embodiment, multiple pairs or sets 80 of insert half sections 11 and 12 are formed by assembling a pair of half sections and inserting them into a sleeve 81 to maintain the pair assembled. The multiple sets 80 may then be placed in a larger box 14' for shipment. If desired, the sleeve may be omitted.

While particular embodiments of the invention have been illustrated and described in detail herein, it should be understood that various changes and modifications may be made to the invention without departing from the spirit and intent of the invention as defined by the scope of the appended claims.

What is claimed is:

1. A shipping and display container for fragile articles, comprising:

a pair of substantially identical, mating half sections each made from a single individual blank of paper material folded to define a rectangular back wall panel and spaced apart, hollow, box-like quadrilateral support structures at opposite sides of the back wall panel, said quadrilateral support structures each being formed by upwardly and inwardly turned panels at opposite edges of an back wall panel, wherein said back wall panel forms a back wall of each quadrilateral support structure, the upwardly turned panel forms an outer side wall thereof, an inwardly turned panel forms a top wall thereof extending in parallel spaced relationship to the back wall panel, a downwardly turned panel on an inner edge of the top wall forms an inner side wall extending in parallel spaced relationship to the outer side wall, and a further inwardly turned panel at a bottom edge of each inner side wall extends in overlying relationship to the back wall panel and toward and into contiguous relationship with the further inwardly turned panel on an opposed inner side wall to form a double bottom for the container;

said top wall and inner side wall of each quadrilateral structure having cut outs formed therein, defining spaced apart recessed supports for supporting opposite ends of at least one article along three spatial axes when an article is placed in the recessed supports of a half section, said recessed supports being spaced from the bottom and outer side walls such that an article supported thereon is maintained in spaced relationship to said walls, said half sections being configured so that one half section can support at least one article in a secure and visible orientation for display, and a pair of the half sections can be placed together in mirror image registry with one another on opposite sides of at least one article to enclose the article and define a shipping container for secure shipping of the article.

2. A shipping and display container as claimed in claim 1, wherein:

each recessed support has a radial support element for engaging at that support a radial dimension of an elongate article having an axial dimension and a radial dimension and placed in the support.

3. A shipping and display container as claimed in claim 2, wherein:

an elongate article placed in the support has axially oriented opposite ends, and each recessed support has an axial support element that engages a respective axially oriented opposite end of that article supported in said one half section to limit axial movement of that article.

4. A shipping and display container as claimed in claim 1, wherein: each recessed support includes a radial support element and an axial support element.

5. A shipping and display container as claimed in claim 1, wherein:

the cut outs include a first portion in the inner side wall of each quadrilateral structure, and a second portion in the top wall of each quadrilateral structure, said first portions comprising the radial support elements and said second portions comprising the axial support elements.

6. A shipping and display container as claimed in claim 5, wherein:

the cut outs in the quadrilateral structure at one side of the half section include a U-shaped cut in the inner side wall and a pair of parallel straight lines extending in the top wall from the top of the U-shaped cut toward the adjacent outer side wall and perpendicular thereto and terminating at outer ends short of the outer side wall, defining a piece of material joined to the top wall along a fold line extending between the outer ends of the straight lines, said piece of material folded downwardly into the quadrilateral structure and having a first section joined to the fold line and extending parallel to but spaced from the outer side wall and defining the axial support element in that quadrilateral structure, and a second section joined along a fold line to a lower end of the first section and defining a pad lying flat against the back wall of the half section.

7. A shipping and display container as claimed in claim 6, wherein:

the lower panel and pad are adhesively secured to the back wall.

8. A shipping and display container as claimed in claim 7, wherein:

bottom wall end flaps are foldably joined to opposite ends of said bottom wall, side wall end flaps are foldably joined to opposite ends of said outer side walls, and inner side wall flaps are foldably joined to opposite ends of said inner side wall, in each quadrilateral structure; and said side wall flaps are folded inwardly over opposite ends of the respective quadrilateral structures.

9. A shipping and display container as claimed in claim 8, wherein:

said bottom wall flaps include first bottom wall flaps foldably joined to opposite ends of the double thickness bottom wall, and second bottom wall flaps foldably joined to opposite ends of the bottom wall in the area beneath the quadrilateral structures.

10. A shipping and display container as claimed in claim 9, wherein:

the inner side wall flaps are folded inwardly toward one another across opposite ends of the double thickness bottom wall;

said second bottom wall flaps are folded upwardly and inwardly over the outer side wall flaps to close the ends of the quadrilateral structures and hold them in erected condition; and said first bottom wall flaps include a first section folded upwardly against an outer surface of the inner side wall flaps, and a second section folded downwardly against an inside surface of the inner side wall flaps, forming opposite ends walls for the half section.

11. A shipping and display container as claimed in claim 10, wherein:

a pair of half sections are assembled together in mating, mirror image relationship to one another to enclose one or more articles and form an insert; and said insert is inserted into a box to form said container.

12. A shipping container for bottles or other frangible articles, comprising:

an insert formed by a pair of substantially identical, mating insert half sections each made from a respective single blank of paper material folded to have a bottom wall and tubular support structures at opposite sides thereof, and flaps on opposite ends of the bottom wall and opposite ends of the tubular support structures, some of said flaps on opposite ends of the bottom wall being foldable into interlocking relationship with some of said flaps on opposite ends of the tubular support structures to form end walls for the insert, and other of said flaps on opposite ends of the bottom wall and on opposite ends of the tubular support structures being foldable into and over opposite ends of the tubular support structures to rigidify the tubular support structures and hold them in erected condition, said tubular support structures forming outer side walls of the half section, said inserts being foldable or collapsible into a flattened condition for storage and shipment of the insert when it is empty, each support structure having recessed portions defining supports for nesting and supporting at least one article along three spatial axes and in spaced relationship to the bottom wall and outer side walls, said half sections placed together in registry with one another and with an article on opposite sides of the article to enclose it; and a box in which the insert is placed to hold the mating half sections together.

13. A shipping container as claimed in claim 12, wherein:

the insert half sections are each formed from a single blank of folded corrugated cardboard.

14. A shipping container as claimed in claim 13, wherein:

the insert half sections each comprise a plurality of foldably interconnected panels; at least some of said panels interlocking to hold the half section in its erected condition.

15. A shipping container as claimed in claim 14, wherein:

adhesive is used between some panels to enhance the strength and rigidity of the insert section, and to assist in holding the insert section in its erected condition.

16. A shipping and display container for bottles, comprising:

a pair of substantially identical, mating half sections each made from a respective single blank of paper material folded to define spaced apart recessed supports for supporting opposite ends of at least one elongate article along three spatial axes when the article is placed in the recessed supports of the half section, said half sections being configured so that one half section can support at least one article in a secure and visible orientation for display, and a pair of half sections can be placed together in mirror image registry with one another on opposite sides of at least one article to enclose said at least one article and define a shipping container for secure shipping of said at least one article, said elongate article having axially oriented opposite ends and a radial dimension, and each recessed support has an axial support element that engages a respective axially oriented opposite end of an article supported in said one half section to limit axial movement of the article, and a radial support element that engages approximately one half the radial dimension of the article at that support, whereby an article resting on said supports is nested up to approximately one half its radial dimension in one said half section, each half section having a bottom wall, opposite side walls and opposite end walls, and said support elements are spaced from the walls such that an article supported thereon is maintained in spaced relationship to said walls, said recessed supports in each half section being formed in quadrilateral structures at opposite sides of said half section, said quadrilateral structures each formed by a respective side wall and adjoining portion of the bottom wall of a half section, and by a top wall panel foldably joined to a top edge of the respective side wall and extending laterally inwardly therefrom over the back wall in parallel, spaced relationship thereto, and terminating at an inner edge thereof in an inner wall panel foldably joined to the inner edge of the top wall panel and extending downwardly in parallel, spaced relationship to the respective side wall, and terminating at a lower edge thereof in a lower panel lying flat against the back wall and extending toward the opposite side of the half section.

17. A shipping and display container as claimed in claim 16, wherein:

the recessed supports are formed by cut outs in the quadrilateral structures at opposite sides of the half section, the cut outs including a first portion in the inner wall panel of each quadrilateral structure, and a second portion in the top wall panel of each quadrilateral structure, said first portions comprising the radial support elements and said second portions comprising the axial support elements.

18. A shipping and display container as claimed in claim 17, wherein:

the cut outs in the quadrilateral structure at one side of the half section include a U-shaped cut in the side wall panel and a pair of parallel straight lines extending from the top of the U-shaped cut toward the adjacent side wall and perpendicular thereto and terminating at outer ends short of the side wall, defining a piece of material joined to the top wall panel along a fold line extending between the outer ends of the straight lines, said piece of material folded downwardly into the quadrilateral structure and having a first section joined to the fold line and extending parallel to but spaced from the side wall and defining the axial support element in that quadrilateral structure, and a second section joined along a fold line to a lower end of the first section and defining a pad lying flat against the back wall of the half section.

19. A shipping and display container as claimed in claim 18, wherein:

the lower panel and pad are adhesively secured to the back wall.

20. A shipping and display container as claimed in claim 19, wherein:

bottom wall end flaps are foldably joined to opposite ends of said bottom wall, side wall end flaps are foldably joined to opposite ends of said side walls, and inner wall panel flaps are foldably joined to opposite ends of said inner wall panel, in each quadrilateral structure; and said side wall flaps are folded inwardly over opposite ends of the respective quadrilateral structures.

21. A shipping and display container as claimed in claim 20, wherein:

the lower panels extend inwardly over the bottom wall into contiguous relationship with one another, forming a double thickness bottom wall extending between the quadrilateral structures at opposite sides of the half section; and said bottom wall flaps include first bottom wall flaps foldably joined to opposite ends of the double thickness bottom wall, and second bottom wall flaps foldably joined to opposite ends of the bottom wall in the area beneath the quadrilateral structures.

22. A shipping and display container as claimed in claim 21, wherein:

the inner wall panel flaps are folded inwardly toward one another across opposite ends of the double thickness bottom wall;

said second bottom wall flaps are folded upwardly and inwardly over the side wall flaps to close the ends of the quadrilateral structures and hold them in erected condition; and said first bottom wall flaps include a first section folded upwardly against an outer surface of the inner wall panel flaps, and a second section folded downwardly against an inside surface of the inner wall panel flaps, forming opposite ends walls for the half section.

23. A shipping and display container as claimed in claim 22, wherein:

a pair of half sections are assembled together in mating, mirror image relationship to one another to enclose one or more articles and form an insert; and said insert is inserted into a box to form said container.

* * * * *